United States Patent [19]

Hsieh

[11] Patent Number: 4,970,933

[45] Date of Patent: Nov. 20, 1990

[54] REINFORCED MUSICAL DRUM RIM

[76] Inventor: Wu H. Hsieh, No. 178, Chung Shan Erh Rd., Taipei, Taiwan

[21] Appl. No.: 406,739

[22] Filed: Sep. 13, 1989

[51] Int. Cl.[5] ..... G10D 13/00

[52] U.S. Cl. ..... 84/413; 84/411 R

[58] Field of Search ..... 84/411–420

[56] References Cited

U.S. PATENT DOCUMENTS

| | | | |
|---|---|---|---|
| 794,658 | 7/1905 | Boulanger | 84/411 R |
| 1,121,909 | 12/1914 | Elkins et al. | 84/411 R |
| 3,376,777 | 4/1968 | Becker-Ehmck | 84/419 |
| 4,428,272 | 1/1984 | Andre et al. | 84/413 |

*Primary Examiner*—Lawrence R. Franklin

*Attorney, Agent, or Firm*—Browdy and Neimark

[57] ABSTRACT

A a reinforced musical drum rim including a drum rim in which: a concavity is cut out of the underside of said drum rim; in said concavity is established a honeycomb-like reinforcement structure comprising a chain of hexagonally shaped reinforcements; a plurality of equally spaced screw hole units through which respective clamping screws are passable are disposed within the reinforcement structure so that deformation occuring in the drum rim due to the tightening of the clamping screws is prevented.

1 Claim, 4 Drawing Sheets

REINFORCED MUSICAL DRUM RIM

BACKGROUND OF THE INVENTION

This invention relates to a clamping rim of a musical drum, and more particularly to a reinforced clamping rim.

A drum's percussional tone ensures when its drumhead is beaten. A particular percussional tone is derived by maintaining a certain tension in the drumhead. This tension is achieved when the drumhead is stretched over the upper brim of the drum body and clamped under a rim. Clamping screws pass through the rim and screw into threaded receptacles mounted on the side of the drum body. When the clamping screws are tightened, the rim clamps the drumhead down, stretching it across the drum body.

The conventionally designed drum rim comprises a metal lip which fits over the brim of the drum body. Disposed on the outer edge of this lip is a plurality of tabs. In the center of each tab is a hole through which a clamping screw passes. These clamping screws then screw into threaded receptacles mounted on the side of the drum body. The tightening of the clamping screws, then, exerts a pressure on the drum rim which stretches the drumhead over the brim of the drum body. However, because the structure of the drum rim comprises this plurality of tabs protruding from the metal lip, it is easily deformed by the pressure exerted by the tightening of the clamping screws. This deformation of the drum rim in turn affects the tension maintained across the drumhead causing aberration in the percussional tone.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide an improved drum rim design wherein the rim is reinforced against deformation.

Further objectives and advantages of the present invention will become apparent as the following description proceeds, and the features of novelty which characterize the invention are pointed out with particularly in the claims annexed to and forming a part of this invention.

DETAILED DESCRIPTION OF THE PREFERRED EMBODIMENT

Figure 1:
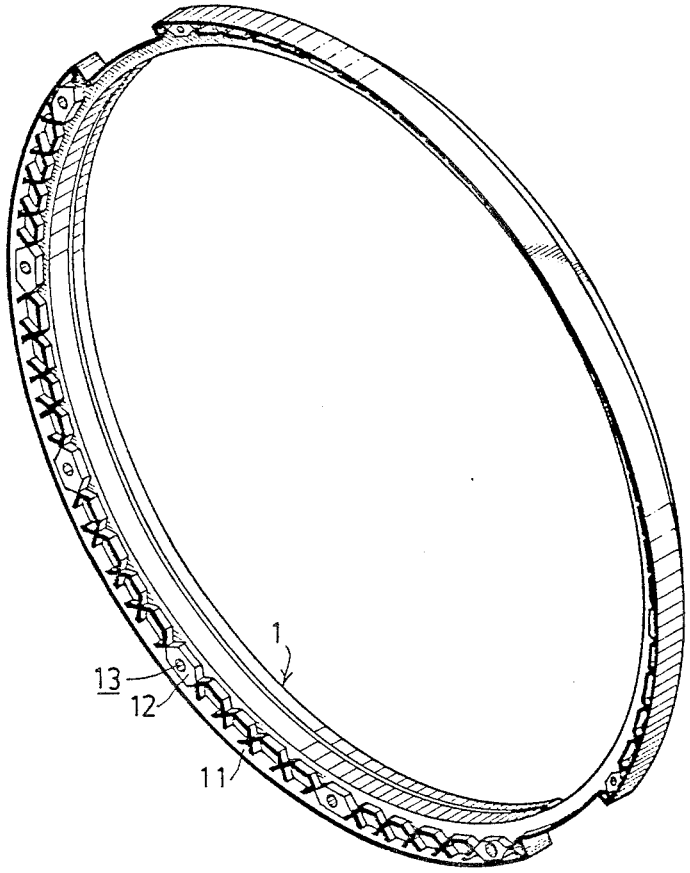
FIG. 1 is a perspective view of a reinforced musical drum rim in accordance with the present invention.
Figure 2:
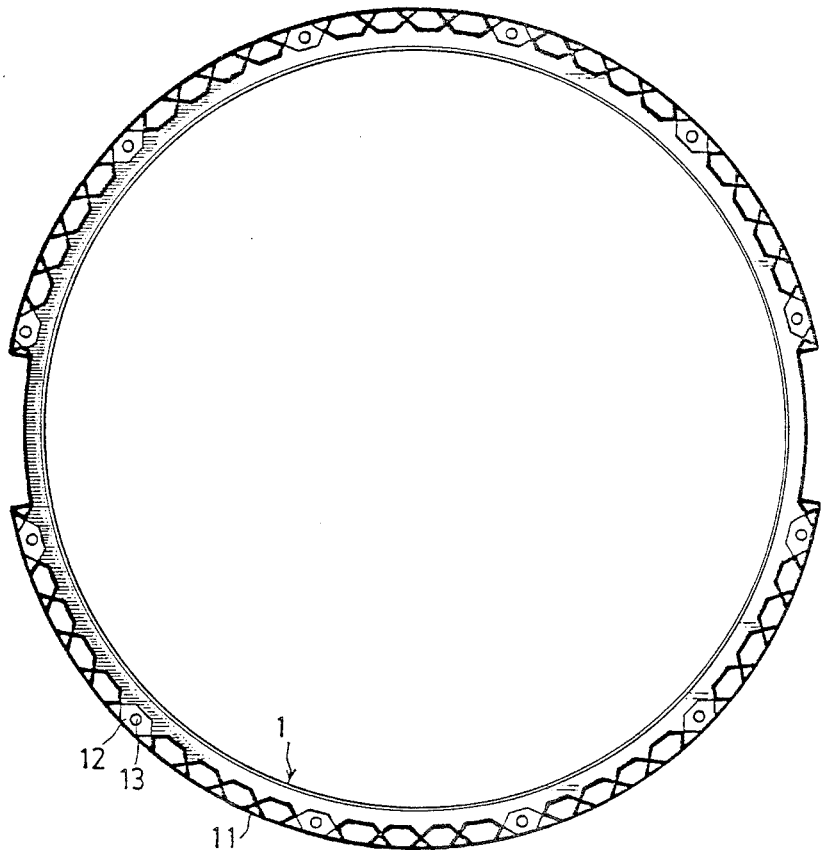
FIG. 2 is a plane view the reinforced musical drum rim of FIG. 1 in accordance with the present invention.

Referring to FIGS. 1 and 2, it can be seen that the present inventional generally comprises a drum rim (1). On the underside of this drum is cut a concavity (11) within which is established a honeycomb-like reinforcing structure (12). This reinforcing structure (12) generally comprises a chain of hexagonally shaped reinforcements. Within this reinforcing structure (12) is disposed a plurality of equally spaced hexagonal screw hole units (13). Respective clamping screws (2) pass through the screw hole units (13) in order to clamp the drumhead (31) between the drum rim (1) and the drum body (3).

Figure 3:
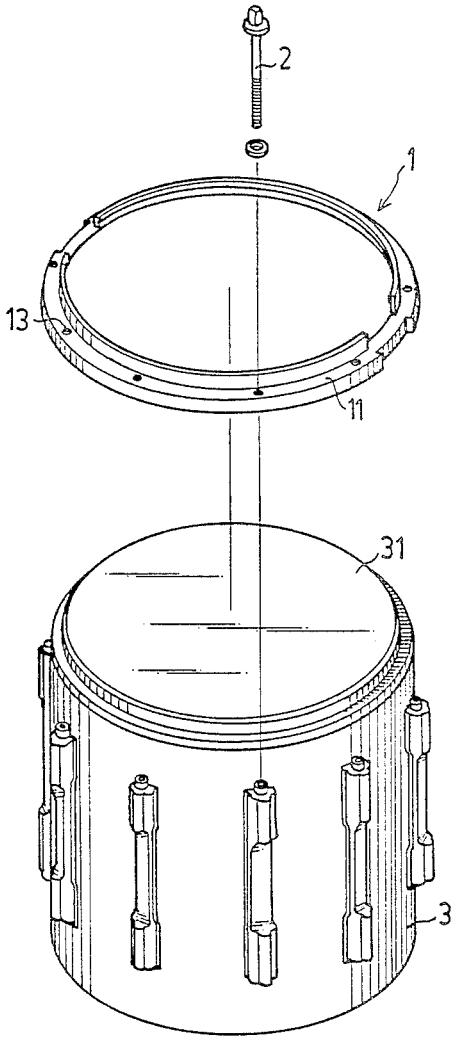
FIG. 3 is an exploded view of as musical drum with a reinforced rim in accordance with the present invention.
Figure 5:
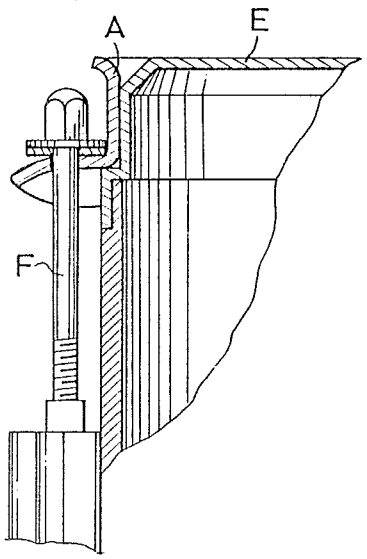
FIG. 5 PRIOR ART
FIG. 5 is a prior art of a conventional drum rim in the clamped state.
Figure 4:
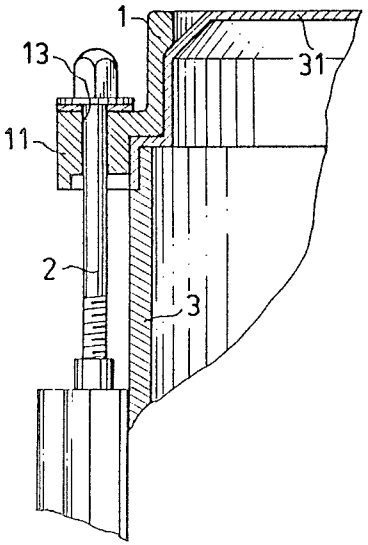
FIG. 4 is a sectional view of FIG. 1 in the clamped state.

Referring now to FIGS. 3 and 4 it can be seen that the tightening of the clamping screws (2) pulls down on the drum rim (1) causing the rim (1) to, in turn, exert a pressure on the drumhead (31) stretching it over the brim of the drum body (3). Because the screw hole units (13) are contained within the structure of the drum rim (11), and not on a plurality of tabs protruding from the rim as shown in the prior art FIG. 5, deformation of the drum rim (1) during clamping is prevented. Moreover, the honeycomb-like reinforcing structure (12) within the rim further strengthens the rim structure (11) so that deformation during clamping is prevented thus ensuring maintenance of the originally intended clear percussional tone.

As various possible embodiments might be made of the above invention without departing from the scope of the invention, it is to be understood that all matter herein described or shown in the accompanying drawing is to be interpreted as illustrative and not in as limiting sense. Thus it will be appreciated that the drawings are exemplary of a preferred embodiment of the invention.

I claim:

1. A reinforced musical drum rim comprising a drum rim (1) wherein:

a concavity (11) is cut out of the underside of said drum rim (11); in said concavity (11) is established a honeycomb-like reinforcement structure (12) comprising a chain of hexagonally shaped reinforcements; a plurality of equally spaced screw hole units (13) through which respective clamping screws are passable are disposed within the reinforcement structure so that deformation occurring in the drum rim (1) due to the tightening of the clamping screws (2) is prevented.

* * * * *